United States Patent [19]

Murphy, Jr. et al.

[11] 4,085,036

[45] Apr. 18, 1978

[54] PROCESS OF HYDRODESULFURIZATION AND SEPARATE SOLVENT EXTRACTION OF DISTILLATE AND DEASPHALTED RESIDUAL LUBRICATING OIL FRACTIONS

[75] Inventors: Harry C. Murphy, Jr., Apollo; Harry C. Stauffer, Cheswick, both of Pa.

[73] Assignee: Gulf Research & Development Company, Pittsburgh, Pa.

[21] Appl. No.: 737,491

[22] Filed: Oct. 1, 1976

[51] Int. Cl.[2] ..... C10G 23/00; C10G 34/00

[52] U.S. Cl. ..... 208/212

[58] Field of Search ..... 208/212, 216, 264

[56] References Cited

U.S. PATENT DOCUMENTS

| | | | |
|---|---|---|---|
| 2,846,358 | 8/1958 | Bieber et al. | 208/212 |
| 2,865,839 | 12/1958 | Halter et al. | 208/96 |
| 2,985,586 | 5/1961 | Willson et al. | 208/216 |
| 3,020,228 | 2/1962 | Demeester | 208/216 |
| 3,414,506 | 12/1968 | Van Lookeren Campagne | 208/264 |
| 3,970,543 | 7/1976 | McIntosh | 208/212 |

*Primary Examiner*—George Crasanakis

[57] ABSTRACT

A process for the production of lubricating oils from petroleum stocks containing significant quantities of sulfur and lubricating oil components boiling above about 650° F. (343° C.) by subjecting such stocks to a series of steps comprising hydrodesulfurization, fractionation, and solvent extraction. The residual fraction obtained from the fractionation step may be deasphalted prior to solvent extraction.

5 Claims, No Drawings

PROCESS OF HYDRODESULFURIZATION AND SEPARATE SOLVENT EXTRACTION OF DISTILLATE AND DEASPHALTED RESIDUAL LUBRICATING OIL FRACTIONS

BACKGROUND OF THE INVENTION

In the production of lubricating oils from crude petroleum stocks, the crude oil is fractionated to obtain a product wherein at least 90 volume percent of such product boils in the lubricating oil range i.e. above about 650° F. (343° C.). As employed throughout this specification, this fraction obtainable by the atmospheric distillation of a crude oil will be termed a "crude lubricating oil". Traditionally, this crude lubricating oil is subjected to a further distillation, conducted at less than atmospheric pressure, to obtain a distillate fraction and a residual lubricating oil fraction. The residual lubricating oil fraction is then subjected to deasphalting such as by treatment with a light hydrocarbon solvent, e.g. propane.

The substantially asphaltic-free residual lubricating oil and distillate lubricating oil fractions are then independently subjected to a processing step to reduce the aromatic content thereof and to increase the viscosity index (V. I.). This processing step generally comprises contacting the lubricating oil feed with a solvent selective for aromatics.

The raffinate or semi-refined lubricating oil obtained from the solvent extraction step is dewaxed to lower the pour point to a desired level. Finally, the dewaxed oil is subjected to a finishing operation to make small adjustments in the characteristics in the oil. Conventional finishing operations include a mild hydrogen treatment, acid contacting and clay contacting wherein minor concentrations of contaminants such as sulfur are removed.

When the above-described lubricating oil manufacturing process is employed for crude lubricating oils containing significant concentrations of sulfur, yields of finished lubricating oil base stocks are substantially reduced and processing requirements for dewaxing and finishing the processed lubricating oils are more severe with a resultant substantial increase in the costs of manufacture. Additionally, the high sulfur concentration of the extract fraction recovered from the solvent extraction step makes it undesirable to use the extract conventionally in the production of low sulfur fuel oils.

SUMMARY OF INVENTION

An improved process for processing sulfur-containing crude lubricating oil feed stocks is provided whereby a feed stock containing a crude lubricating oil fraction having at least 1.5 weight percent sulfur is initially subjected to a hydrodesulfurization step in which at least 60% and preferably about 75% desulfurization of the crude lubricating oil fraction is effected, the hydrodesulfurized product fractionated to produce distillate (neutral) and residual (bright stock) fractions, and the distillate and deasphalted residual fractions subsequently solvent extracted to separate aromatics therefrom.

DESCRIPTION OF THE INVENTION

The feed stocks to which the process of this invention are applicable are those petroleum crude oils which contain a significant fraction boiling in the lubricating oil range (at least 90 volume percent boiling above 650°

F. (343° C.) at atmospheric pressure). As previously indicated, this fraction conventionally obtained by the atmospheric distillation of a crude oil is termed a "crude lubricating oil". Although the full petroleum crude can be employed as the feed stock to the process of this invention, it is preferred that the feed to the hereafter described desulfurization step comprise a crude lubricating oil. The crude lubricating oil fractions of the feed stock to the process of this invention are those containing a sulfur concentration of at least 1.5 weight percent. The process of this invention is particularly applicable to feed stocks wherein the crude lubricating oil fraction contains a sulfur concentration of at least 3.5 weight percent such as Kuwait crude oils.

The feed stock is contacted with a hydrodesulfurization catalyst in the presence of hydrogen under hydrodesulfurization processing conditions. The operating conditions generally employed include a temperature in the range of about 600° to about 900° F. (316° to about 482° C.), a pressure in the range of about 300 to about 2,500 psi (14.1 to 176 kgs/sq.cm.) and a space velocity in the range of about 0.1 to about 10 volumes of feed stock per volume of catalyst per hour. A hydrogen partial pressure in the range of 200 to 2,000 psi (14.1 to 141 kgs/sq.cm.) is maintained in the hydrodesulfurization zone. The hydrogen feed rate to the hydrodesulfurization zone is maintained in the range from about 1,000 to about 5,000 standard cubic feet per barrel (28,320 to 141,500 liters/159 liters) of feed stock. It is not necessary to employ pure hydrogen stream in the hydrodesulfurization reaction, but the hydrogen concentration of the gaseous stream should be at least about 50 percent by volume.

The catalyst employed in the hydrodesulfurization step can be any of those catalysts generally employed in the hydrodesulfurization of residual hydrocarbons. Typically, the catalyst can comprise a combination of at least one hydrogenation component selected from each of Groups VI-B and VIII metals, their oxides and sulfides or mixtures thereof, and a refractory metal oxide. The total concentration of the hydrogenation metals employed in the hydrodesulfurization stage will normally range from about 5.0 to about 16.0 weight percent. A combination of metalliferous components, such as cobalt-molybdenum, nickel-molybdenum, nickel-cobalt-molybdenum, nickel-tungsten, etc. can be utilized in the catalyst composition. Preferably, the hydrogenation component is dispersed on a refractory oxide carrier of high surface area, such as, for example, alumina, silica-alumina, silica-magnesia, etc. In addition to the Group VI-B and Group VIII metal components, the hydrodesulfurization catalyst can contain a promoter such as described in U.S. Pat. No. 3,840,473.

The operating conditions employed in the hydrodesulfurization step are selected so as to produce a product crude lubricating oil fraction having a concentration of sulfur not greater than 40 and preferably about 25 weight percent of the sulfur content of the crude lubricating oil feed to the desulfurization step. If required, multiple hydrodesulfurization steps can be employed, optionally utilizing different catalyst compositions, to obtain a crude lubricating oil product fraction having the desired sulfur concentration. If a full crude is employed as the feed to the desulfurization step, a distillation step may be required to separate the crude lubricating oil fraction from the hydrodesulfurization product.

The crude lubricating oil product of the hydrodesulfurization step is fractionated, under vacuum, so as to obtain a residual fraction and one or more distillate fractions. Typically, the residual fraction comprise a material wherein at least 90 percent of the material has a boiling range above about 950° F. (510° C.). For example, the distillate portion may be divided into a light neutral having a Saybolt Universal viscosity in the range of 39.0 to 43.5 seconds at 210° F. (99° C.), a medium neutral having a Saybolt Universal viscosity in the range of 49.0 to 57.5 seconds at 210° F. (99° C.) and a heavy neutral having a Saybolt Universal viscosity in the range of 72.0 to 100.0 seconds at 210° F. (99° C.).

The residual fraction is subjected to a deasphalting process step. Any of the techniques well known in the art can be employed, such as, for example, propane deasphalting. In propane deasphalting, temperatures in the range from about 130° to 180° F. (54° to 82° C.) and pressures in the range from about 400 to 550 psi (28 to 38.5 kgs./sq.cm.) are generally employed. Further, propane to oil volume ratios from about 6:1 to about 10:1 are normally employed with ratios as high as 13:1 being employed at times.

In the extraction process step a solvent which preferentially dissolves aromatic hydrocarbons and which is at least partially miscible with the charge oil under the conditions of contacting is employed. Suitable solvents include phenol, furfural, sulfur dioxide, and the like. The solvent and the charge oil are contacted by various means, as for example, by a batch or continuous process. However, in general, conventionally contact between the solvent and the oil is effected in a counter current treating operation conducted in a tower. Under such conditions the solvent is normally introduced into the upper part of the tower of column and the oil is introduced at the middle or bottom section of the column tower. Contact between the countercurrently flowing phases is effected under conventional temperatures and pressure conditions so as to form a paraffinic raffinate phase and a solvent aromatic extract phase. When employing furfural as the selective solvent, solvent to oil ratio of 1.0 to 4.5, a top tower temperature in the range of 190° F. (87.8° C.) to 270° F. (132.2° C.) and a bottom tower temperature in the range of 135° F. (57.2° C.) to 210° F. (98.9° C.) are normally maintained in the contacting tower. The solvent is separated from the raffinate and extract products of the contacting step and the raffinate subsequently subjected to dewaxing and one or more lube oil finishing steps such as hydrofinishing and clay treating.

In the immediately preceding discussion, deasphalting and solvent extration for the removal of aromatic have been treated as two separate operations. It is also within the scope of our invention to employ a dual solvent technique, such as Duo-Sol extraction, wherein the lubricating oil fraction is treated with two solvents effective for the simultaneous deasphalting and removal of aromatics from the oil. Typically, propane is employed as the paraffinic solvent for the deasphalting aspect, while cresylic acid or cresol, generally containing up to about 40 volume percent phenol, is employed to remove aromatics. Typical operating conditions for Duo-Sol extraction include temperatures in the range from about 90 up to about 150° F. (32 up to about 66° C.) and a solvent to oil volume ratio of about 4:1 for each of the solvents.

To illustrate the invention, the following specific embodiment is presented. A Kuwait crude lubricating oil feed stock (56 volume percent is full crude) characterized as follows:

| | | |
|---|---|---|
| Gravity: ° API | 17.1 | |
| Viscosity, SUV: Sec. (Cs.) | | |
| 100° F. (37.8° C) | 2,220 | (479) |
| 150° F. (65.6° C) | 475 | (102.2) |
| 210° F. (98.9° C) | 135 | (28.3) |
| Sulfur, wt. % | 3.86 | |
| Pour Point: ° F | 55 | |
| Carbon Residue, Conradson: wt. % | 8.5 | |

was mixed with hydrogen and passed to the top of hydrodesulfurization column wherein it was desulfurized under the following conditions:

| | | |
|---|---|---|
| Pressure: psig (kg/sq.cm.) | 2,100 | (147.7) |
| Average Catalyst Temperature: ° F. (° C) | 741 | (394° C) |
| Space Velocity: Vol. Oil/Hr./ Vol. Cat. | 0.61 | |
| Charge Gas at Inlet | | |
| Rate: SCF/BBL (SCM/100 L) | 4,300 | (76.5400 SCM/100 L) |
| Hydrogen Content: mole % | 94.1 | |

The lubricating oil product of the hydrodesulfurization step and the Kuwait crude lubricating oil feed stock as characterized above were independently passed to a vacuum distillation column where distillate fractions and a residual fraction were separated by a conventional steam-assisted distillation technique. The residual fraction recovered from each of the vacuum distillation runs was subjected to a conventional deasphalting process step by passing the charge upwardly through a column in countercurrent relationship with a propane solvent at a solvent to charge oil ratio of about 8.0/1 Vol./Vol. and with the deasphalting column operated at a top temperature ranging from about 150° F. (65.6° C.) to 195° F. (90.6° C.).

The distillate and deasphalted residuum products of the vacuum distillation step for the Kuwait crude lubricating oil feed stock (Virgin Feed Stock) and the Kuwait hydrodesulfurized crude lubricating oil feed stock (HDS Feed Stock) were characterized as follows:

TABLE I

| | Light Distillate | | Medium Distillate | | Heavy Distillate | | Deasphalted Residuum | |
|---|---|---|---|---|---|---|---|---|
| Feed Stock Source: | Virgin | HDS | Virgin | HDS | Virgin | HDS | Virgin | HDS |
| Product Yield: | | | | | | | | |
| Vol % of Kuwait Raw Crude | 9.0 | 10.0 | 9.0 | 8.0 | 5.0 | 7.0 | 6.8 | 8.7 |
| Product Properties | | | | | | | | |
| Gravity: ° API | 25.5 | 28.4 | 21.5 | 25.6 | 17.5 | 22.8 | 20.5 | 23.6 |
| Viscosity: SUS at 210° F (99° C) | 40.0 | 39.5 | 58.0 | 51.5 | 109 | 81.0 | 200 | 175 |
| Pour Point: ° F | 75 (24° C) | 70 (21° C) | 100 (38° C) | 100 (38° C) | 120 (49° C) | 110 (43° C) | 130 (54° C) | 135 (57° C) |
| Sulfur: wt % | 2.58 | 0.21 | 2.88 | 0.28 | 3.40 | 0.35 | 2.80 | 0.43 |

From the above it is apparent that hydrodesulfurization of the Kuwait crude lubricating oil resulted in higher gravity products with a volume yield increase of 3.9 percent based upon the raw crude when producing fractions of equivalent or lower viscosities.

Each of the above fractions were separately solvent extracted by passing the feed stock upwardly through an extraction column in countercurrent contacting relationship with furfural with a solvent to oil ratio of 4.5/1 Vol./Vol. max. maintained in the column. The top temperature of the column was maintained at 270° F. (132.2° C.) max. and the bottom temperature of the column was maintained at 210° F. (98.9° C.) max. Raffinate and extract fractions recovered from the solvent extraction step were characterized as follows:

TABLE II

| | Light Distillate | | Medium Distillate | | Heavy Disillate | | De-asphalted Residuum | |
|---|---|---|---|---|---|---|---|---|
| | Virgin | HDS | Virgin | HDS | Virgin | HDS | Virgin | HDS |
| Raffinate Yield: | | | | | | | | |
| Vol % of Charge | 71.0 | 71.5 | 65.0 | 74.5 | 55.0 | 67.0 | 68.0 | 70.0 |
| Vol % of Kuwait Raw Crude | 6.39 | 7.15 | 5.85 | 5.96 | 2.75 | 4.69 | 4.62 | 6.09 |
| Product Properties | | | | | | | | |
| Raffinate Gravity: ° API | 33.3 | 33.8 | 29.3 | 30.6 | 27.0 | 29.1 | 25.9 | 27.0 |
| Viscosity: SUV, SEC at at 210° F (99° C) | 39.5 | 39.0 | 49.5 | 47.8 | 73.5 | 65.2 | 158.0 | 148.0 |
| Sulfur: wt % | 1.00 | 0.05 | 1.10 | 0.10 | 1.20 | 0.12 | 1.35 | 0.23 |
| Extract Sulfur: wt % | 5.90 | 0.56 | 5.60 | 0.73 | 5.40 | 0.76 | 4.80 | 0.86 |

From the above, it is apparent that the raffinate yields of the hydrodesulfurized crude lubricating oil feed stock is substantially higher than the corresponding raffinate yields from the virgin crude lubricating oil feed stock. This yield advantage (23.89 volume percent versus 19.61 volume percent of the raw crude) can also be seen in the yields of finished lubricating oil stocks recovered after solvent dewaxing and hydrofinishing the above raffinate products.

Each of the above raffinate streams were solvent dewaxed and hydrofinished to produce finished lubricating oil base stocks. Solvent dewaxing was conducted in a conventional manner using a mixture of MEK and toluene to produce dewaxed oils having the same pour point. The hydrofinishing step was done over a range of conditions comprising the following:

| | |
|---|---|
| Pressure: psig (kg/cm$^2$) | 1,000 (70.3) – 1,700 (119.5) |
| Space Velocity: Vol. Oil/Hr./Vol. Cat. | 1.5 – 3.5 |
| Average Catalyst Temperature: ° F. (° C) | 660 (349° C)– 700 (371° C) |
| Charge Gas at Inlet Rate: SCF/BBL (SCM/100 L) | 2,000 (35.6 SCM/100 L) |
| Hydrogen Content: mole % | 80 – 96 |

Finished lubricating oil base stocks obtained from solvent dewaxing and hydrofinishing the raffinate product fractions of Table II were characterized as shown below in Table III.

TABLE III

| | Light Distillate | | Medium Distillate | | Heavy Distillate | | De-asphalted Residuum | |
|---|---|---|---|---|---|---|---|---|
| | Virgin | HDS | Virgin | HDS | Virgin | HDS | Virgin | HDS |
| Finished Lube Base Stock Yield: | | | | | | | | |
| Vol % of Raffinate | 80.0 | 81.5 | 82.0 | 83.0 | 77.0 | 80.5 | 76.0 | 78.5 |
| Vol % of Raw Crude | 5.11 | 5.83 | 4.80 | 4.95 | 2.18 | 3.78 | 3.51 | 4.78 |
| Properties | | | | | | | | |
| Gravity: °API | 33.0 | 32.2 | 29.8 | 29.3 | 29.5 | 28.5 | 27.0 | 26.0 |
| Viscosity, SUV: Sec. 100° F (38° C) | 105 | 105 | 250 | 250 | 600 | 600 | 2369 | 2369 |
| 210° F (99° C) | 39.7 | 39.7 | 49.2 | 49.2 | 68.3 | 68.3 | 155.0 | 155.0 |
| VI | 95 | 95 | 95 | 95 | 95 | 95 | 95 | 95 |
| Pour Point: ° F | 0 | 0 | 0 | 0 | 0 | 0 | 0 | 0 |
| Sulfur: wt % | 0.08 | 0.02 | 0.10 | 0.04 | 0.15 | 0.05 | 0.25 | 0.10 |

As previously noted with respect to increased raffinate yields, the inventive process results in a substantial yield increase when compared with conventional processing (19.34 versus 15.60 volume percent of raw crude) for 95 VI finished lubricating base stocks. In hydrofinishing the hydrodesulfurized dewaxed oil product obtained by the process of this invention, less hydrogenation capacity is required than in the case of processing the dewaxed oil product of the virgin feed stock.

Although the invention has been described with reference to specific embodiments, references, and details, various modifications and changes will be apparent to one skilled in the art and are contemplated to be embraced in this invention.

We claim:

1. A process which comprises (a) contacting a crude oil having a crude lubricating oil fraction containing at least 1.5 weight percent sulfur with hydrogen and with a hydrogenation catalyst to obtain a hydrodesulfurized product wherein at least 60 percent by weight of the sulfur contained in said crude lubricating oil fraction has been separated therefrom, (b) fractionating the hydrodesulfurized product of step (a) to obtain a residual lubricating oil fraction 90 percent of which boils above 950° F. and at least one distillate lubricating oil fraction 90 percent of which boils above 650° F. (c) deasphalting said residual lubrication oil fraction, (d) separately extracting said at least one distillate lubricating oil fraction and said deasphalted residual lubricating oil fraction with a solvent selected from the group of phenol, furfural or sulfur dioxide and mixtures thereof to reduce the aromatic content of said at least one distillate fraction and said deasphalted residual lubricating oil fraction, said extracting being performed in a counter current tower, wherein the solvent is introduced into the top section of the tower and the oil fraction from step (c) is introduced at the middle or bottom section of the tower under conventional temperatures and pressures, and (e) separating the solvent from the extracted lubricating oil products.

2. A process which comprises (a) contacting a crude lubricating oil containing at least 3.5 weight percent sulfur and with hydrogen and with a hydrogenation catalyst under hydrodesulfurization conditions to obtain a hydrodesulfurized product wherein at least 60 weight percent of the sulfur has been separated therefrom, (b) fractionating the hydrodesulfurized product of step (a) to obtain a residual lubricating oil fraction and at least one distillate lubricating oil fraction. (c) deasphalting said residual lubricating oil fraction, (d) separately extracting said at least one distillate lubricating oil fraction and said deasphalted residual lubricating oil fraction with a solvent selected from the group of phenol, furfurol or sulfur dioxide and mixtures thereof to reduce the aromatic content of said at least one distillate fraction and said deasphalted residual lubricating oil fraction, said extracting being performed in a counter current tower, wherein the solvent is introduced into the top section of the tower and the oil fraction from step (c) is introduced at the middle or bottom section of the tower under conventional temperatures and pressures, and (e) separating the solvent from the extracted lubricating oil products.

3. The process of claim 2 wherein at least 75 weight percent of the sulfur is removed from the crude lubricating oil feed to the hydrodesulfurization step (a).

4. The process of claim 1 which includes said residual lubricating oil fraction with propane under deasphalting conditions.

5. The process of claim 2 which includes contacting said residual lubricating oil fraction in step (c) with propane under deasphalting conditions.

* * * * *

UNITED STATES PATENT OFFICE
CERTIFICATE OF CORRECTION

Patent No. 4,085,036 Dated April 18, 1978

Inventor(s) Harry C. Murphy, Jr. and Harry C. Stauffer

It is certified that error appears in the above-identified patent and that said Letters Patent are hereby corrected as shown below:

Col. 3, line 33, "tower of column" should read -- tower or column --.

Col. 3, line 50, "aromatic" should read -- aromatics --.

Col. 4, line 12, "percent is full crude" should read -- percent of full crude ---.

Col. 5, lines 2 & 3, "when producing fractions" should read -- when producing product fractions --.

Claim 1, Col. 6, line 48 [said residual lubrication oil] should read said residual lubricating oil.

Claim 2, Col. 6, line 64 [sulfur and with hydrogen] should read sulfur with hydrogen.

Claim 4, Col. 8, lines 7-9 [The process of claim 1 which includes said residual lubricating oil fraction with propane under deasphalting conditions.] should read -- The process of claim 1 which includes contacting said residual lubricating oil fraction in step (c) with propane under deasphalting conditions.

Signed and Sealed this

Twenty-second Day of August 1978

[SEAL]

Attest:

RUTH C. MASON
Attesting Officer

DONALD W. BANNER
Commissioner of Patents and Trademarks